US006128936A

United States Patent [19]

Yogo

[11] Patent Number: 6,128,936

[45] Date of Patent: Oct. 10, 2000

[54] BULGING DEVICE AND BULGING METHOD

[75] Inventor: Teruaki Yogo, Nagoya, Japan

[73] Assignee: Kabushiki Kaisha Opton, Aichi-ken, Japan

[21] Appl. No.: 09/368,234

[22] Filed: Aug. 4, 1999

[30] Foreign Application Priority Data

Sep. 9, 1998 [JP] Japan ..... 10-255118
Sep. 9, 1998 [JP] Japan ..... 10-255119

[51] Int. Cl.[7] ..... B21D 39/08

[52] U.S. Cl. ..... 72/58; 72/61; 72/62; 29/421.1

[58] Field of Search ..... 72/58, 59, 61, 72/62; 29/421.1

[56] References Cited

U.S. PATENT DOCUMENTS

| | | | |
|---|---|---|---|
| 4,352,280 | 10/1982 | Ghosh . | |
| 4,829,803 | 5/1989 | Cudini | 72/61 |
| 5,062,199 | 11/1991 | Kelly | 29/727 |
| 5,303,570 | 4/1994 | Kaiser | 72/61 |
| 5,481,892 | 1/1996 | Roper et al. | 72/61 |
| 5,630,334 | 5/1997 | Ash | 72/61 |
| 6,009,734 | 1/2000 | Augustin et al. | 72/61 |

FOREIGN PATENT DOCUMENTS

| | | |
|---|---|---|
| 0372360 | 11/1989 | European Pat. Off. . |
| 5277574 | 10/1993 | Japan . |
| 7116748 | 5/1995 | Japan . |
| 7155857 | 6/1995 | Japan . |
| 10202328 | 8/1998 | Japan . |

*Primary Examiner*—David B. Jones
*Attorney, Agent, or Firm*—Davis and Bujold

[57] ABSTRACT

A bulging device and a bulging method for bulging a workpiece into an accurate shape, and preventing the generation of cracks therein. High pressure liquid is supplied to the interior space of a workpiece and from an external pressure supply mechanism to the outer space of the workpiece in cavity. An internal pressure detection sensor or an external pressure detection sensor is controlled according to the detected pressure, thereby controlling the pressure of the interior space of the workpiece or the pressure of the outer space of the workpiece in the cavity. Alternatively, position sensors for detecting displacement of pushing dies are provided such that the pressure of the interior space of the workpiece or the pressure of the outer space of the workpiece in the cavity is controlled according to the detected displacement. The workpiece is inserted into the cavity formed by an upper and lower die, and high pressure liquid is supplied to the interior space of the workpiece while an axial compressive force is being applied to the workpiece, thereby bulging the workpiece to follow the contour of the inwardly facing surface of the dies. During this bulging process the pressure of the high pressure liquid period fluctuated.

21 Claims, 6 Drawing Sheets

BULGING DEVICE AND BULGING METHOD

FIELD OF THE INVENTION

The present invention relates to a bulging device and a bulging method for bulging a workpiece, located within a cavity formed by an upper and lower die, by supplying high pressure liquid to the interior space of the workpiece.

BACKGROUND OF THE INVENTION

Conventionally, a bulging device for bulging a workpiece, such as a tube which is inserted into a cavity formed between an upper and lower die, into, for example, a T shape by supplying high pressure liquid to the interior space of the workpiece has been used. Such a bulging device is disclosed in Japanese Non-examined Patent Publication No. 7-155857.

The bulging device, according to the aforementioned prior art, comprises a regulation stopper which is slidable in a swelling formation hole of a die and a control device for controlling movement of the regulation stopper. During bulging of a workpiece, the workpiece is first inserted into the dies, and a high pressure liquid is then supplied to the interior space of the workpiece with the regulation stopper in contact with an outer periphery of the workpiece. And then, as the pressure inside the workpiece increases, the regulation stopper is controlled and moved backward in the swelling formation hole, thereby controlling expansion of the workpiece into the swelling formation hole. By adopting such a method, a swelling portion can be formed on the workpiece while the generation of cracks, caused by a rapid expansion of the workpiece, is prevented.

In the conventional device as aforementioned, however, it is necessary to form the swelling formation hole of such a shape that the regulation stopper can be slidably inserted therein. Thus, the cylindrical shape of which the sectional form is constant in the longitudinal direction can be applied to the shape of the swelling formation hole, while the shape of which the sectional form is variable in the longitudinal direction, such as a bowl shape, can not be applied thereto. The shape of dies applicable to the aforementioned device is thus limited, which has been a continuing problem.

SUMMARY OF THE INVENTION

An object of the present invention is to provide a bulging device and a bulging method for bulging a workpiece without generating cracks therein, irrespective of the shape or contour of the inwardly facing surface of the dies defining a bulging cavity.

A bulging device according to the present invention, in which a workpiece is inserted into a cavity formed by an upper and lower die, and in which high pressure liquid is supplied from an internal pressure supply mechanism to the interior space of the workpiece, an axial compressive force being applied to the workpiece via a pair of opposed pushing dies actuated by pushing mechanisms, thereby bulging the workpiece to conform to the shape of the inwardly facing cavity surface of the dies, comprises:

an external pressure supply mechanism for supplying high pressure liquid to the outer space of the workpiece in the cavity (hereinafter referred to as the "outer space").

There may also be provided, in the bulging device, an internal pressure detection sensor for detecting the pressure of the high pressure liquid supplied from an internal pressure supply mechanism and a control circuit for controlling the pressure of the interior space of the workpiece or the pressure of the outer space by controlling the internal pressure supply mechanism or the external pressure supply mechanism according to the pressure detected by the internal pressure detection sensor.

Alternatively, an external pressure detection sensor, for detecting the pressure of the high pressure liquid supplied from the external pressure supply mechanism, and a control circuit for controlling the pressure of the interior space of the workpiece or the pressure of the outer space by controlling the internal pressure supply mechanism or the external pressure supply mechanism, according to the pressure detected by the external pressure detection sensor, may be provided.

Further, a position sensor for detecting the displacement of the pushing dies and a control circuit for controlling the pressure of the interior space of the workpiece or the pressure of the outer space by controlling the internal pressure supply mechanism or the external pressure supply mechanism, according to the displacement detected by the position sensor, may be provided.

During bulging of a workpiece, rapid expansion of the workpiece can be controlled by supplying high pressure liquid to the outer space, and the workpiece can thus be prevented from being cracked. Moreover, since fluid is employed as a pressure medium, high pressure can be supplied to the outer space regardless of the shape or contour of the inwardly facing surface of the dies defining the cavity. In addition, since the pressure of the high pressure liquid is equally applied to the bulging deformation area of the workpiece, the workpiece can be deformed in a stable condition. The workpiece can thus be bulged without any cracks being generated therein and, accordingly, the bulging device is widely applicable to all types of bulging applications.

Also, bulging work can be performed under suitable conditions according to the material composition and thickness of the workpiece, by controlling the pressure of the interior space of the workpiece and/or the pressure of the outer space.

In cases where high pressure liquid is supplied to the interior space of a workpiece, which is inserted into an upper and a lower die, the contact area of the workpiece with the dies is subject to high pressure. Therefore, the outer surface of the workpiece, in the contact area, receives a greater frictional force from the inwardly facing surface of the dies. On the other hand, in the non-contact area of the workpiece with the dies, that is, in the area where the workpiece tries to expand within the cavity at the time of bulging, no frictional force is generated. Accordingly, two different flow areas are produced during the bulging process of a workpiece: in a first area material flows along the inwardly facing surface of the dies and experiences a great frictional force and, in a second area, material flows without receiving any frictional force. This results in a possibility that the workpiece may become locally thin between the first and second areas, which further results in a possibility of the generation of cracks in the workpiece.

That is why the present invention also proposes to fluctuate the pressure of the pressure liquid being supplied to the interior space of the workpiece or the pressure of the pressure liquid supplied to the outer space during bulging.

Such a bulging method according to the present invention, in which a workpiece is inserted into a cavity formed by an upper and lower die, and in which high pressure liquid is supplied to the interior space of the workpiece, an axial compressive force being applied to the workpiece, thereby bulging the workpiece along the shape of the inwardly facing surface of the dies, comprises a step of:

fluctuating the pressure of the high pressure liquid supplied to the interior space of the workpiece during bulging.

Another bulging method, according to the present invention, may be a method in which a workpiece is inserted into a cavity formed by an upper and a lower die, and in which high pressure liquid is supplied to the interior space of the workpiece, an axial compressive force being applied to the workpiece, thereby bulging the workpiece along the shape or contour of the inwardly facing surface of the dies, comprising the steps of:

supplying high pressure liquid to the outer space; and fluctuating the pressure of the high pressure liquid supplied to the outer space during bulging.

The fluctuation of pressure may be a periodical fluctuation. The pressure in the contact area of the outer surface of the workpiece with the inwardly facing surface of the dies can thus be fluctuated by fluctuating the pressure of the pressure liquid supplied to the interior space of the workpiece and/or the pressure of the pressure liquid supplied to the outer space when the workpiece is bulged and deformed, which also results in the fluctuation of frictional resistance between the workpiece and the dies in the aforementioned contact area. More specifically, the flow resistance, which is caused by frictional forces, of the material of the workpiece, can be reduced at the predetermined time intervals, thereby allowing the material to flow smoothly along the shape or contour of the inwardly facing surface of the dies. As a result, the workpiece can be effectively prevented from becoming locally thin and thus from being cracked, and a precise bulging along the shape or contour of the inwardly facing surface of the dies can be achieved, which are the results of the present invention.

BRIEF DESCRIPTION OF THE DRAWINGS

The preferred embodiments of the present invention are now described in detail with reference to the accompanying drawings, in which.

DESCRIPTION OF THE PREFERRED EMBODIMENTS

Figure 1:
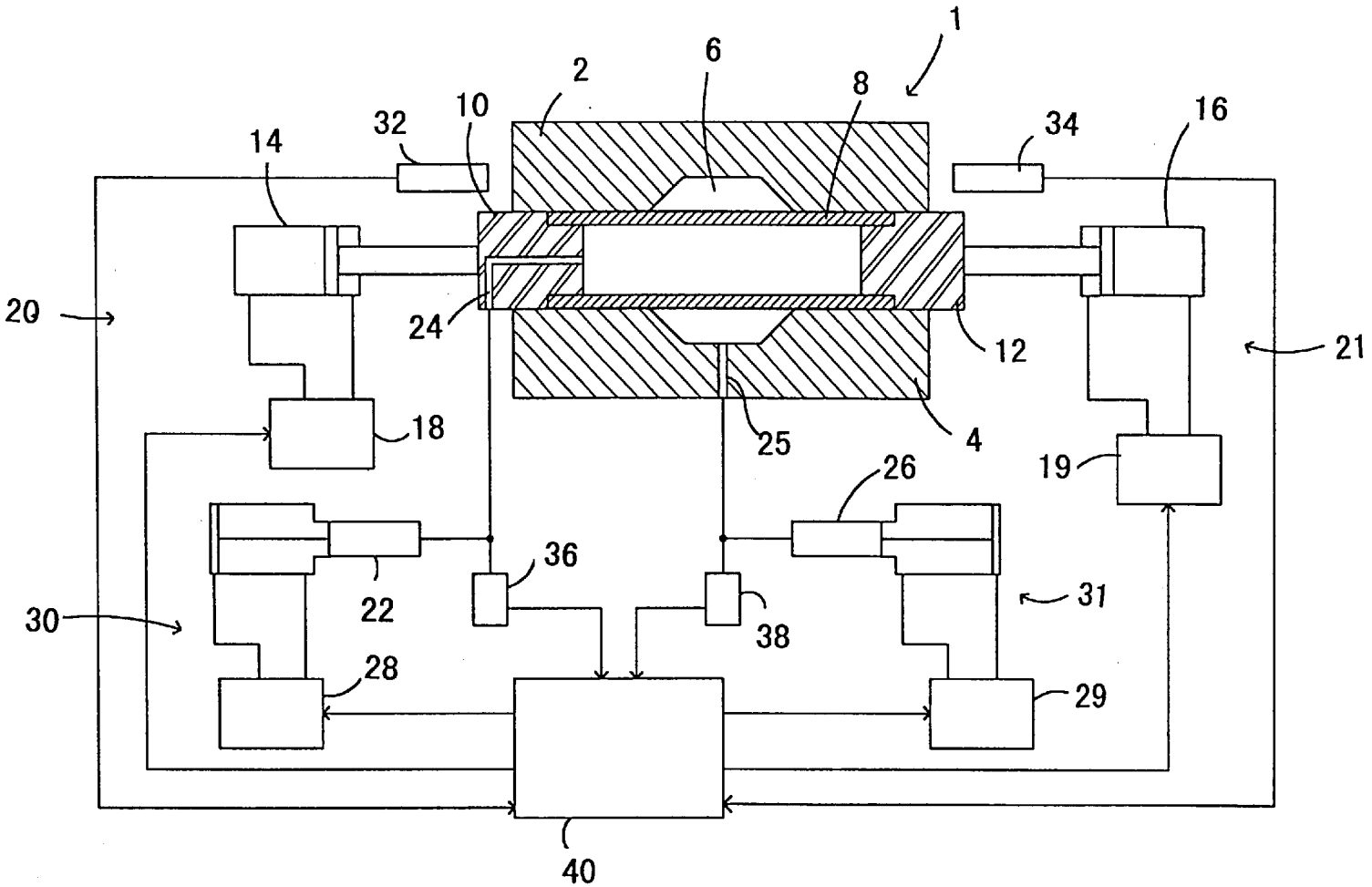
FIG. 1 is a schematic block diagram of a bulging device according to an embodiment of the present invention.

As shown in FIG. 1, the dies 1 are composed of a first upper die 2 and a second lower die 4, and the upper die 2 and the lower die 4 are mounted on a press machine for bulging (not shown). A cavity 6 is formed within the pair of dies 1 when the upper die 2 and the lower die 4 are mated with one another. A workpiece 8, for which a tube is employed in this embodiment, is inserted into the cavity 6. The inwardly facing surface of the dies 1, defining the cavity 6, is formed of such a shape as to allow the middle section of the workpiece 8 to expand by bulging.

Also, a pair of first and second pushing dies 10 and 12 are slidably disposed at both opposed ends of the workpiece 8 which is inserted into the cavity 6 of the dies 1. The outer shape or contour of the pushing dies 10 and 12 substantially coincides with or follows the inner shape or contour of the dies 1, and further, a known sealing structure is provided between the pushing die 10 and the dies 1 as well as between the pushing die 12 and the dies 1, thereby providing an airtight sealing arrangement therebetween. As an example of such a sealing structure, O rings may be disposed between the pushing die 10 and the dies 1 as well as between the pushing die 12 and the dies 1. The pushing dies 10 and 12 are actuated by hydraulic cylinders 14 and 16, respectively, to apply an axial compressive force to the workpiece 8. The hydraulic cylinders 14 and 16 are connected to hydraulic sources 18 and 19, respectively.

The hydraulic sources 18 and 19 are provided for supplying high pressure liquid to the hydraulic cylinders 14 and 16, respectively, and for adjusting the pressure of the pressure liquid according to external signals. In this embodiment, a pushing mechanism 20 is composed of the hydraulic cylinder 14 and the hydraulic source 18, and a pushing mechanism 21 is composed of the hydraulic cylinder 16 and the hydraulic source 19.

An interior space of the workpiece 8 is connected with a first booster 22 via a communicating passage or hole 24 formed in the pushing die 10. In the same manner, the outer space of the workpiece 8 when located within the cavity 6 (hereinafter referred to as the "outer space") is connected with a second booster 26 via a communicating passage or hole 25. The first and second boosters 22 and 26 are connected to hydraulic sources 28 and 29, respectively, such as hydraulic pumps. The hydraulic sources 28 and 29 are provided for supplying a high pressure liquid to the first and second boosters 22 and 26, respectively, and for adjusting the pressure of the pressure liquid according to external signals.

The first and second boosters 22 and 26 intensify the pressure of the pressure liquid supplied from the hydraulic sources 28 and 29, respectively, and then, supply the intensified pressure liquid to the interior space of the workpiece 8 and the outer space, respectively. According to this embodiment, an internal pressure supply mechanism 30 is composed of the first booster 22 and the hydraulic source 28, and an external pressure supply mechanism 31 is composed of the second booster 26 and the hydraulic source 29.

Also, provided in the bulging device, according to this embodiment, are position sensors 32 and 34 for detecting displacement of the pushing dies 10 and 12, respectively. Also provided are an internal pressure detection sensor 36, for detecting the pressure of the pressure liquid supplied from the first booster 22 to the interior space of the workpiece 8, and an external pressure detection sensor 38, for detecting the pressure of the pressure liquid from the second booster 26 to the outer space.

The position sensors 32 and 34, the internal pressure detection sensor 36 and the external pressure detection sensor 38 are all connected to a control circuit 40. The control circuit 40 outputs signals, such as a drive signal for driving a hydraulic pump and a pressure setting signal for setting the pressure of the pressure liquid, according to the signals received form each of the sensors 32, 34, 36 and 38, and also transmits output signals to each of the hydraulic sources 18, 19, 28 and 29.

No detailed description of the control circuit 40 itself is provided herein, except for that the control circuit 40 comprises an I/O interface for transmission and reception of signals between each sensor 32, 34, 36, 38 and each hydraulic source 18, 19, 28, 29, a CPU for providing various kinds of control commands, a ROM for storing control programs, and a RAM for temporarily retaining various data.

Operation of the aforementioned bulging device, according to this embodiment, is now described.

The workpiece 8 is inserted into the cavity 6, and the hydraulic cylinders 14 and 16 are then actuated by being supplied with hydraulic fluid from the hydraulic sources 18 and 19, respectively, such that the front face of each of the pushing dies 10 and 12 contacts an end face of the workpiece 8.

The interior space of the workpiece 8 and the outer space are then filled with low pressure liquid via the communicating holes 24 and 25, respectively, while the first and second boosters 22 and 26 are supplied with high pressure liquid from the hydraulic sources 28 and 29, respectively. An intensified high pressure liquid is supplied, from the first booster 22 via the communicating hole 24, to the interior space of the workpiece 8, while an intensified high pressure liquid is supplied, from the second booster 26 via the communicating hole 25, to the outer space. On the other hand, hydraulic fluid is supplied from the hydraulic sources 18 and 19 to the hydraulic cylinders 14 and 16 to apply an axial compressive force to the workpiece 8 via the pushing dies 10 and 12.

Once high pressure liquid is supplied to the interior space of the workpiece 8, the workpiece 8 expands, due to the pressure thereof, to follow or conform to the shape of the inwardly facing surface of the dies 1. Since the axial compressive force is being applied to the workpiece 8 via the pushing dies 10 and 12, the pushing dies 10 and 12 are displaced in the axial direction with the expansion of the workpiece 8. At the same time, the intensified high pressure liquid is supplied, via the second booster 26, to the outer space.

In this case, by setting the pressure of the outer space lower than the pressure of the interior space of the workpiece 8, the workpiece 8 is expanded to conform to the shape of the inwardly facing surface of the dies 1 due to the pressure differentials therebetween.

As a method of controlling such pressure differentials, it is proposed, for example, to monitor both of the pressures detected by the internal pressure detection sensor 36 and the external pressure detection sensor 38 to control both of the hydraulic sources 28 and 29 such that the pressure of the interior space of the workpiece 8 becomes higher at a predetermined degree than that of the outer space.

In cases where the preferable set values of the internal pressure corresponding to the variation of the internal pressure are previously obtained through tests, it is proposed to monitor the pressure of the interior space of the workpiece 8 detected by the internal pressure detection sensor 36, and to control the pressure of the pressure liquid supplied from the hydraulic source 28 to the first booster 22 such that the pressure of the interior space of the workpiece 8 becomes higher than that of the outer space.

In cases where the preferable set values of the external pressure corresponding to the variation of the external pressure are previously obtained through tests, it is proposed to monitor the pressure of the outer space detected by the external pressure detection sensor 38, and to control the pressure of the pressure liquid supplied form the hydraulic source 29 to the second booster 26 such that the pressure of the outer space becomes lower than that of the interior space of the workpiece 8.

In cases where the preferably set values of the external pressure corresponding to the variation of the internal pressure are previously obtained through tests, it is proposed to monitor the pressure of the interior space of the workpiece 8 detected by the internal pressure detection sensor 36, and to control the pressure of the pressure liquid supplied from the hydraulic source 29 to the second booster 26 such that the pressure of the outer space becomes lower than that of the interior space of the workpiece 8.

In cases where the preferable set values of the internal pressure corresponding to the variation of the external pressure are previously obtained through tests, it is proposed to monitor the pressure of the outer space detected by the external pressure detection sensor 38, and to control the pressure of the pressure liquid supplied from the hydraulic source 28 to the first booster 22 such that the pressure of the interior space of the workpiece 8 becomes higher than that of the outer space.

Figure 2:
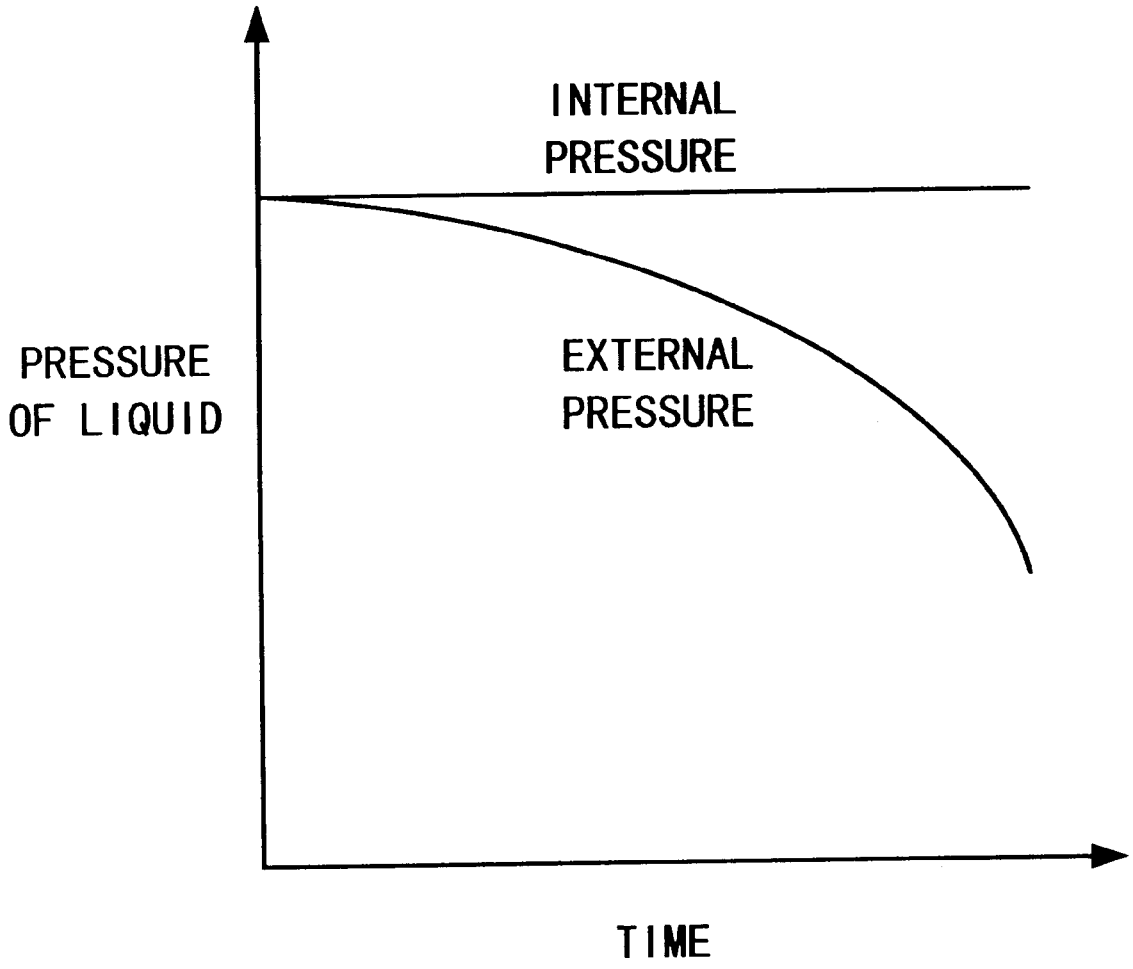
FIG. 2 is a graph showing the relationship between pressure and time according to the embodiment.

As a specific mode of control, for example, it is proposed that, as shown in FIG. 2, the pressure of the interior space of the workpiece 8 (internal pressure) is maintained substantially constantly, while the pressure of the outer space (external pressure) is reduced with the passage of time.

Figure 3:
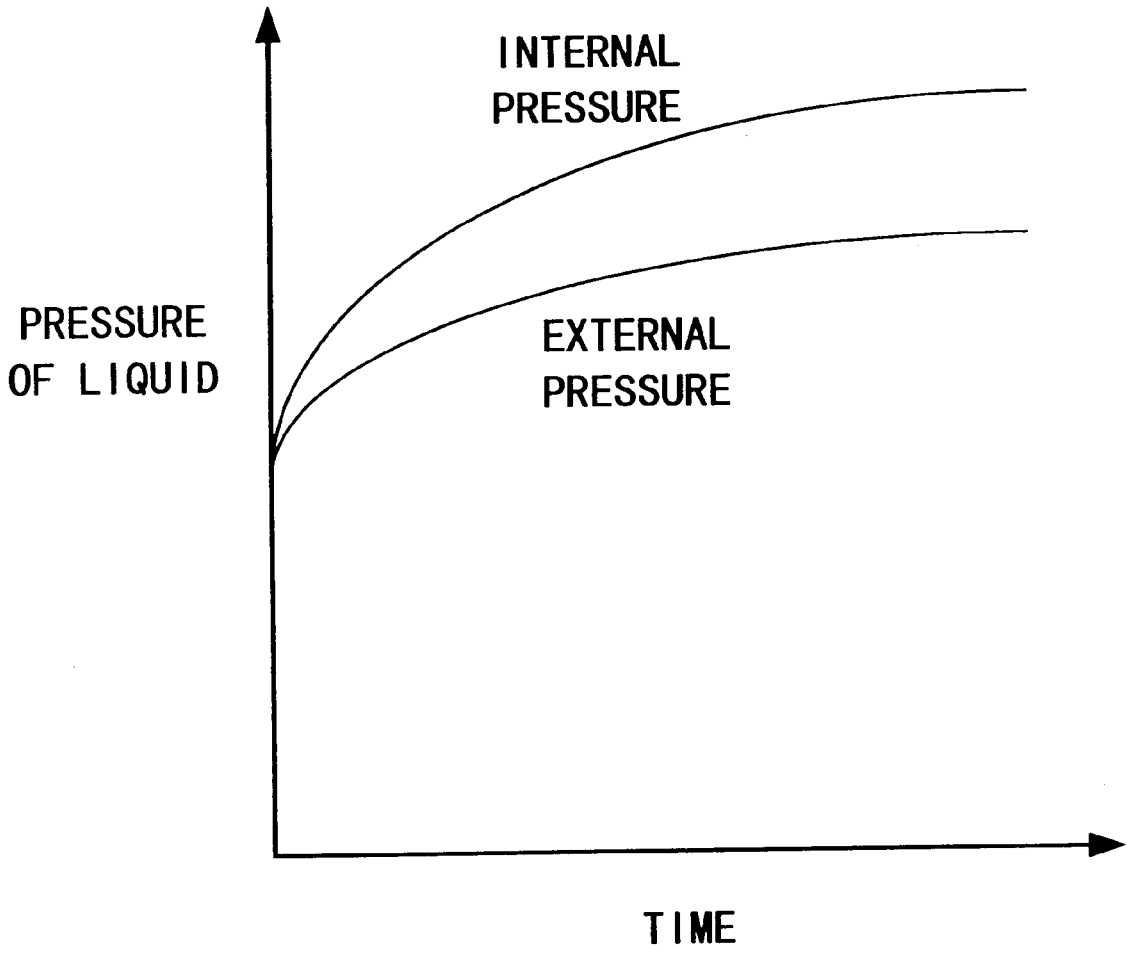
FIG. 3 is a graph showing an alternative relationship between pressure and time according to the embodiment.

Alternatively, as shown in FIG. 3, the pressure of the interior space of the workpiece 8 and the pressure of the outer space may both be increased as time passes. In this case, the degree of increase in the pressure of the interior space of the workpiece 8 should be larger than that of the pressure of the outer space. Also, the degree of increase in pressure differentials may be determined according to the material composition and thickness of the workpiece 8.

Figure 4:
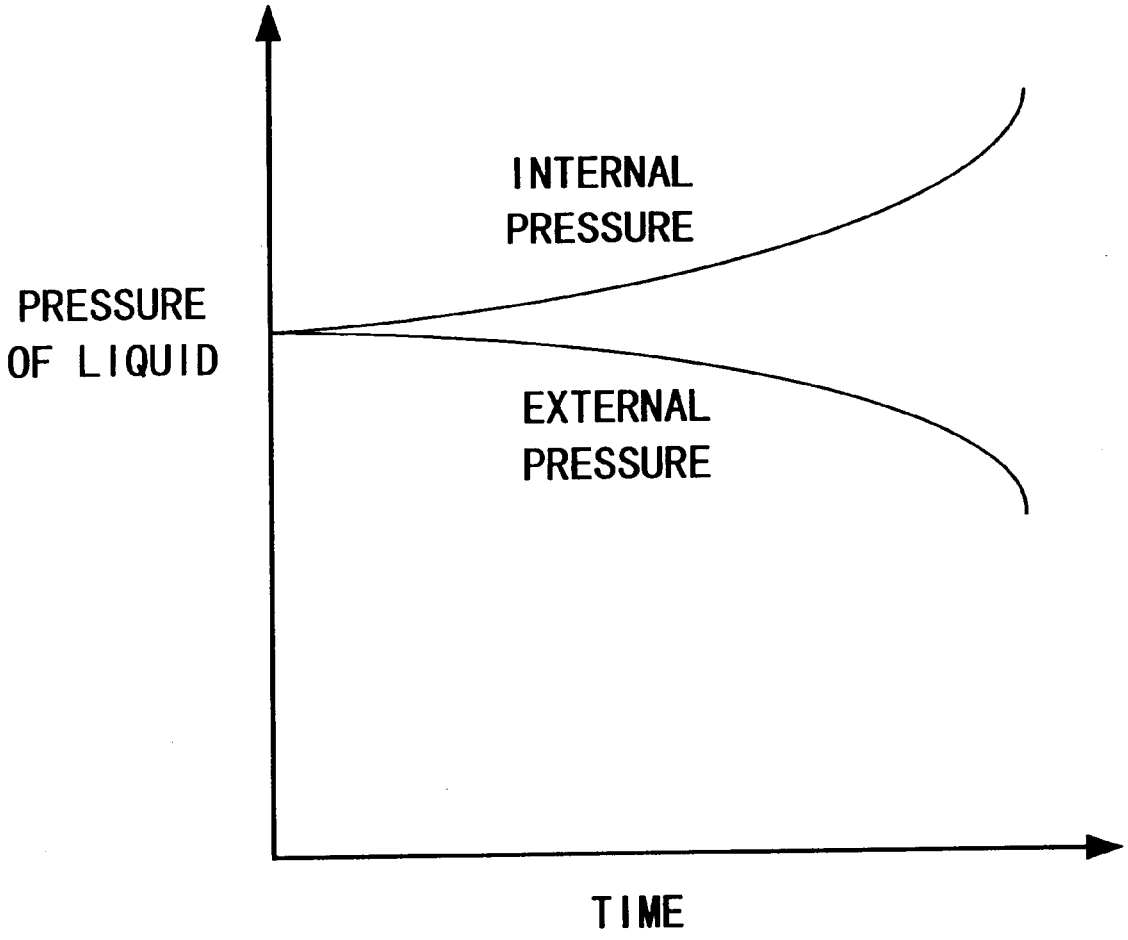
FIG. 4 is a graph showing a further alternative relationship between pressure and time according to the embodiment.

Further, it is proposed that, as shown in FIG. 4, the pressure of the interior space of the workpiece 8 is increased while the pressure of the outer space is reduced with the passage of time. In this case, the degree of increase or reduction in the pressure may be determined according to the material composition and thickness of the workpiece 8.

The progress of bulging of the workpiece 8 can be seen from the displacement of the pushing dies 10 and 12, which is detected by the position sensors 32 and 34, respectively. More specifically, as the bulging of the workpiece 8 progresses, the displacement of the pushing dies 10 and 12 becomes larger. Then, it is proposed to monitor displacement of the pushing dies 10 and 12, and to control the hydraulic source 28, thereby adjusting the pressure of the interior space of the workpiece 8.

Alternatively, it is proposed to monitor displacement of the pushing dies 10 and 12, and to control the hydraulic source 29, thereby adjusting the pressure of the outer space.

Figure 5:
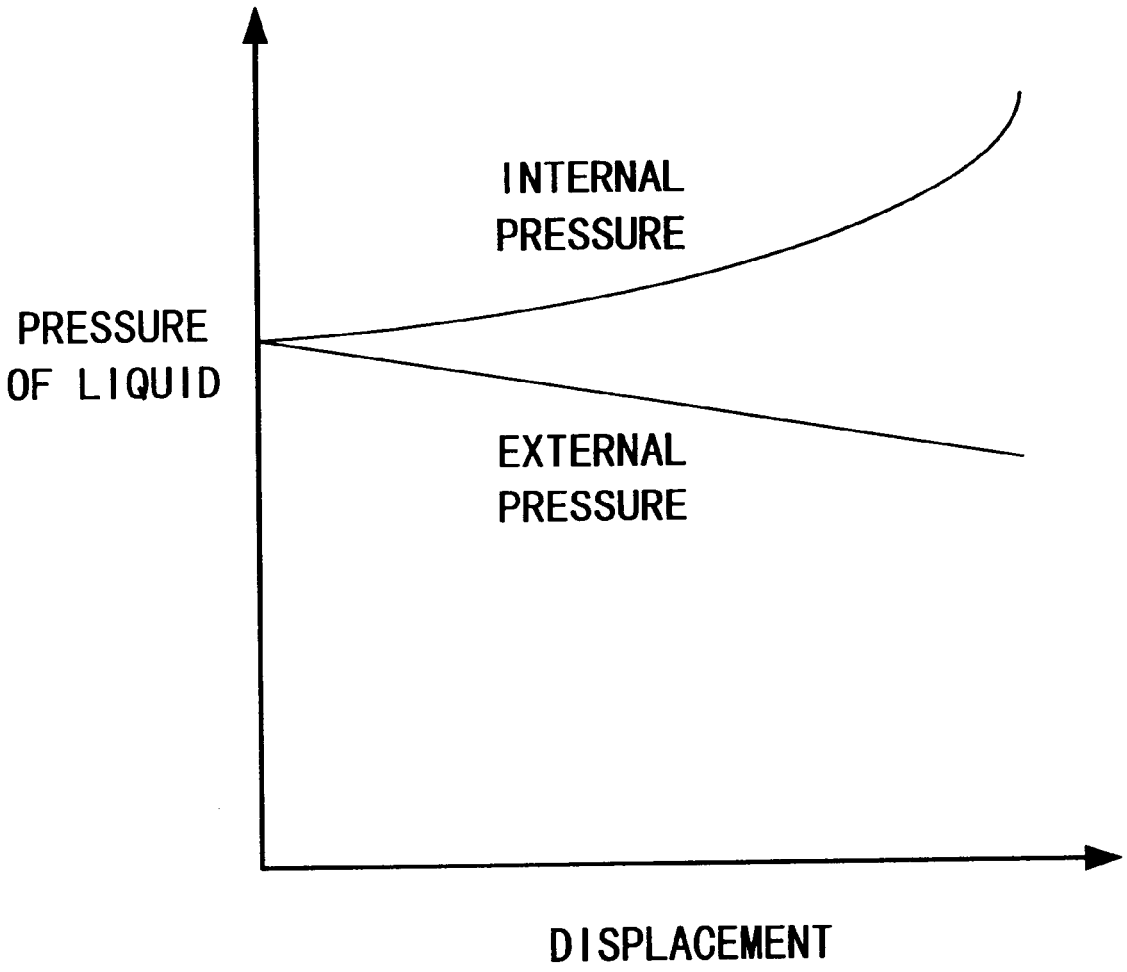
FIG. 5 is a graph showing the relationship between pressure and displacement according to another embodiment of the present invention.

In the aforementioned cases, the pressure of the interior space of the workpiece 8 and the pressure of the outer space may be controlled in the same manner as shown in FIGS. 2, 3 and 4. In this case, the abscissa of each graph shows displacement, not time. Furthermore, it is proposed, for example, that, as shown in FIG. 5, the larger the displacement of the pushing dies 10 and 12 becomes, the more rapidly the pressure of the interior space of the workpiece 8 is increased, while the pressure of the outer space is gradually reduced at a constant rate. By reducing the external pressure gradually, the material flow of the workplace 8 can be precisely controlled at the time the workpiece 8 is bulged and deformed and, therefore, it can be accurately bulged along the shape of or to conform to the inwardly facing surface of the dies 1. Also, it goes without saying that this mode can be applied to the aforementioned control mode based on time.

As aforementioned, as a result of bulging the workpiece 8 by supplying high pressure liquid to the outer space as well as to the interior space of the workpiece 8, rapid expansion of the workpiece 8 can be prevented, which also results in the prevention of cracks in the workpiece 8. In addition, irrespective of the shape of the workpiece 8, the pressure of the pressure liquid is equally applied to the area of deformation of the workpiece and, therefore, a secure bulging can be achieved even in cases where various shapes are adopted as the shape of the cavity 6. Furthermore, by controlling the pressure of the interior space of the workpiece 8 or the pressure of the outer space, bulging can be performed under the suitable conditions according to the material composition and thickness of the workpiece 8.

Now in cases where high pressure liquid is supplied to the interior space of the workpiece 8 which is disposed within the dies 1, the contact area of the workpiece 8 with the dies 1 is subject to high pressure and, consequently, the outer surface of the workpiece 8, in the contact area, receives greater frictional forces from the inwardly facing surface of the dies 1. On the other hand, in the non-contact area of the workpiece 8 with the dies 1, where the workpiece 8 tries to expand within the cavity 6 at the time of bulging, no frictional forces are generated. Therefore, two different flow areas are produced in the workpiece 8 during the bulging process: in one area, material flows along the inwardly facing surface of the dies 1 receiving a greater frictional force; and in the other area, material flows without receiving any frictional force. This results in a possibility that the workpiece 8 may become locally thin between the two areas, which further results in a possibility of the generation of cracks in the workpiece 8.

That is why the present invention also proposes to fluctuate the pressure liquid supplied to the interior space of the workpiece 8 and/or the pressure of the pressure liquid supplied to the outer space during bulging.

Figure 6A:
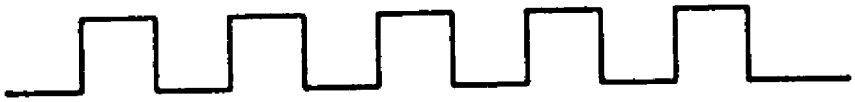
FIGS. 6A and 6B are graphs showing two modes of fluctuation of pressure according to the embodiments.
Figure 6B:
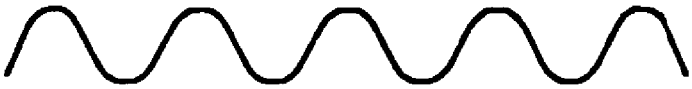

For example, the hydraulic source 28 may be controlled by the control circuit 40, thereby fluctuating the pressure of the hydraulic fluid supplied from the hydraulic source 28 to the booster 22. Consequently, the pressure of the high pressure liquid supplied from the booster 22 to the interior space of the workpiece 8 is fluctuated as well. As an example, the pressure of the hydraulic fluid from the hydraulic source 28, as shown in FIG. 6A, is fluctuated as a periodical rectangular wave. Alternatively, the pressure of the hydraulic fluid may be fluctuated as a periodical sine wave, as shown in FIG. 6B.

In the above cases, the pressure of the high pressure liquid supplied from the booster 22 to the interior space of the workpiece 8 is fluctuated in a rectangular wave and, consequently, the pressure of the contact area of the outer surface of the workpiece 8 with the inwardly facing surface of the dies 1 is fluctuated as well, which also results in the fluctuation of the frictional resistance between the workpiece 8 and the dies 1 in the contact area. That is, the flow resistance of the material of the workpiece 8 caused by the aforementioned frictional force can be reduced at the predetermined time intervals. The material easily flows when the flow resistance is small. Therefore, the material can smoothly flow along the shape or contour of the inwardly facing surface of the dies 1. As a result, it is appreciated that the workpiece 8 can be effectively prevented from becoming locally thin and thus from being cracked during bulging, and a precise bulging along the shape or contour of the inwardly facing surface of the dies 1 can be achieved. The proper values of the aforementioned fluctuation period and fluctuation amplitude of pressure may be determined, in advance, according to the type of workpiece 8 through tests.

Alternatively, the hydraulic source 29 may be controlled by the control circuit 40 to fluctuate the pressure of the hydraulic fluid supplied from the hydraulic source 29 to the booster 26, thereby bulging the workpiece 8 in the same manner as aforementioned. Furthermore, it is also possible that the pressure of the hydraulic fluid from the hydraulic source 28 and the pressure of the hydraulic fluid from the hydraulic source 29 are both fluctuated during bulging.

It is also proposed to fluctuate the pressure of the interior space of the workpiece 8 by controlling the hydraulic source 28 according to the displacement of the pushing dies 10 and 12. Alternatively, the pressure of the outer space may be fluctuated by controlling the hydraulic source 29 according to the displacement of the pushing dies 10 and 12. Further, the pressure of the hydraulic fluid from the hydraulic source 28 and the pressure of the hydraulic fluid from the hydraulic source 29 may both be fluctuated according to the displacement of the pushing dies 10 and 12. For example, the pressure of the interior space of the workpiece 8 is fluctuated when the displacement of the pushing dies 10 and 12 exceeds a predetermined threshold, thereby making it possible to precisely bulge the workpiece 8, especially at the last stage of the bulging process, along the shape or contour of the inwardly facing surface of the dies 1.

The present invention is, of course, not restricted to the embodiments herein described and may be practiced or embodied in still other ways without departing from the subject matter thereof. In the above described embodiment, for example, a periodical rectangular wave and a periodical sine wave are indicated as a fluctuation manner of the pressure of hydraulic fluid; however, needless to say, it may be a triangular wave, a trapezoidal wave, and other various waves. Also, bulging can be performed under atmospheric pressure, but it is of course possible to perform the bulging in a special external environment, that is under a high pressure or the like.

What is claimed is:

1. A bulging device for producing bulges in a workpiece while minimizing formation of cracks and thinning in the workpiece during bulging, said bulging device comprising:

a pair of first and second mating dies defining a cavity therebetween, an inwardly facing surface of said first and second mating dies being contoured to form a desired bulged shape of the workpiece;

a pushing mechanism for providing an axial compressive force to the workpiece, when located between said first and second mating dies, to facilitate bulging of the workpiece to conform to a contour of the inwardly facing surface of said first and second mating dies defining the cavity; and an external pressure supply mechanism for supplying a high pressure liquid to an outer space, defined between the inwardly facing surface of said first and second mating dies and an exterior surface of the workpiece, when located within said first and second mating dies.

2. The bulging device according to claim 1, wherein said pushing mechanism comprises a pair of opposed pushing mechanisms which operate in combination with one another to apply the axial compressive force to the workpiece.

3. The bulging device according to claim 2, wherein each of said pushing mechanisms comprises a pushing die which is connected to a hydraulic cylinder, said hydraulic cylinder is coupled to a source of hydraulic pressure which controls operation of said hydraulic cylinder, and movement of the hydraulic cylinder, in turn, controls movement of said pushing die.

4. The bulging device according to claim 3, wherein the bulging device further comprises a first booster for supplying a high pressure liquid to an interior space of the workpiece, and said first booster is coupled to a source of hydraulic fluid and supplies the high pressure liquid via a passage formed within one of the pushing dies.

5. The bulging device according to claim 4, wherein the external pressure supply mechanism comprises a second booster for supplying a high pressure liquid to the outer space, and the second booster is coupled to a source of hydraulic fluid and supplies the high pressure liquid via a passage formed within one of the first and second mating dies.

6. The bulging device according to claim 3, wherein said bulging device further comprises an internal pressure supply mechanism for supplying a high pressure liquid to an interior space of the workpiece, when located between said first and second mating dies, via a passage formed within one of the pushing dies.

7. The bulging device according to claim 3, wherein said bulging device further comprises an internal pressure supply mechanism for supplying a high pressure liquid to an interior space of the workpiece, when located between said first and second mating dies, via a passage formed within one of the pushing dies.

8. The bulging device according to claim 7, wherein said bulging device further comprises a position sensor for detecting displacement of said pushing dies and a control circuit for controlling the pressure of an interior space of the workpiece, when located between said first and second mating dies, and the pressure of the outer space of said workpiece by controlling one of said internal pressure supply mechanism and said external pressure supply mechanism according to the displacement detected by said position sensor.

9. The bulging device according to claim 3, wherein said bulging device further comprises a position sensor for detecting displacement of said pushing dies, said position sensor comprises a pair of sensors with a first one of said pair sensors mounted for detecting displacement of a first one of the pushing dies and a second one of the pair of sensors mounted for detecting displacement of a second one of the pushing dies.

10. The bulging device according to claim 1, wherein said bulging device further comprises an internal pressure supply mechanism for supplying a high pressure liquid to an interior space of the workpiece, when located between said first and second mating dies, via a passage formed within one of the pushing dies.

11. The bulging device according to claim 10, wherein said bulging device further comprises an internal pressure detection sensor for detecting the pressure of the high pressure liquid supplied from said internal pressure supply mechanism, and a control circuit for controlling one of the pressure of the interior space of the workpiece and the pressure of the outer space by controlling at least one of said internal pressure supply mechanism and said external pressure supply mechanism according to the pressure detected by said internal pressure detection sensor.

12. The bulging device according to claim 10, further comprising an external pressure detection sensor for detecting the pressure of the high pressure liquid supplied from said external pressure supply mechanism, and a control circuit for controlling at least one of the pressure of the interior space of the workpiece and the pressure of the outer space by controlling at least one of said internal pressure supply mechanism and said external pressure supply mechanism according to the pressure detected by said external pressure detection sensor.

13. The bulging device according to claim 10, wherein said bulging device further comprises:

an internal pressure detection sensor for detecting a pressure of the high pressure liquid supplied by said internal pressure supply mechanism;

an external pressure detection sensor for detecting a pressure of the high pressure liquid supplied by said external pressure supply mechanism;

a position sensor for detecting displacement of said pushing mechanism; and each of said internal pressure detection sensor, said external pressure detection sensor and said position sensor is coupled to a control circuit for controlling the operation of said bulging device.

14. The bulging device according to claim 10, wherein a control circuit is coupled to:

said internal pressure supply mechanism;

said external pressure supply mechanism; and said pushing mechanism for controlling operation of said bulging device.

15. A method of producing bulges in a workpiece while minimizing formation of cracks and thinning therein during bulging, said method comprising the steps of:

inserting a workpiece within a cavity formed between a pair of first and second mating dies;

supplying a high pressure liquid to an inner area of the workpiece to create an expansive force within an interior space of the workpiece;

applying an axial compressive force to the workpiece thereby to bulge said workpiece so as to conform to an inwardly facing contour of the cavity formed by said first and second mating dies;

supplying a high-pressure liquid to an outer space defined between the inwardly facing contour of the cavity and an exterior surface of said workpiece; and fluctuating the pressure of said high pressure liquid supplied to the interior space of said workpiece, during the bulging process.

16. The bulging device according to claim 15, further comprising the step of periodically fluctuating the pressure of the high pressure liquid supplied to the interior space of said workpiece.

17. The bulging method according to claim 15, further comprising the step of periodically fluctuating one of the pressure of the high pressure liquid supplied to the interior space of said workpiece, and the pressure of the high pressure liquid supplied to the outer space defined between the workpiece and said cavity.

18. A method of producing bulges in a workpiece while minimizing formation of cracks and thinning therein during bulging, said method comprising the steps of:

inserting a workpiece within a cavity formed between a pair of first and second mating dies;

supplying a high pressure liquid to an inner area of the workpiece to create an expansive force within an interior space of the workpiece;

applying an axial compressive force to the workpiece thereby to bulge said workpiece so as to conform to an inwardly facing contour of the cavity formed by said first and second mating dies;

supplying a high pressure liquid to an outer space defined between the inwardly facing contour of the cavity and an exterior surface of said workpiece; and, fluctuating the pressure of said high pressure liquid supplied to the outer space, during the bulging process.

19. The bulging method according to claim 18, further comprising the step of periodically fluctuating one of the pressure of the high pressure liquid supplied to the interior space of said workpiece, and the pressure of the high pressure liquid supplied to the outer space defined between the workpiece and said cavity.

20. A method of producing bulges in a workpiece while minimizing formation of cracks and thinning therein during bulging, said method comprising the steps of:

inserting a workpiece within a cavity formed between a pair of first and second mating dies;

supplying a high pressure liquid to an inner area of the workpiece to create an expansive force within an interior space of the workpiece;

applying an axial compressive force via a pushing mechanism to the workpiece thereby to bulge said workpiece so as to conform to an inwardly facing contour of the cavity formed by said first and second mating dies; and periodically fluctuating the pressure of said high pressure liquid supplied to the interior space of said workpiece, during the bulging process, wherein said step of periodically fluctuating the pressure is carried out when a pushing value attained by said pushing mechanism exceeds a predetermined threshold.

21. A method of producing bulges in a workpiece while minimizing formation of cracks and thinning therein during bulging, said method comprising the steps of:

inserting a workpiece within a cavity formed between a pair of first and second mating dies;

supplying a high pressure liquid to an inner area of the workpiece to create an expansive force within an interior space of the workpiece;

supplying a high pressure liquid to an outer space defined between the inwardly facing contour of the cavity and an exterior surface of said workpiece;

supplying an axial compressive force via a pushing mechanism to the workpiece thereby to bulge said workpiece so as to conform to an inwardly facing contour of the cavity formed by said first and second mating dies; and periodically fluctuating the pressure of said high pressure liquid supplied to said outer space during the bulging process, wherein said step of periodically fluctuating the pressure is carried out when a pushing value attained by said pushing mechanism exceeds a predetermined threshold.

* * * * *